US006477825B2

(12) United States Patent
Katagiri et al.

(10) Patent No.: US 6,477,825 B2
(45) Date of Patent: Nov. 12, 2002

(54) FLATTENING AND MACHINING METHOD AND APPARATUS

(75) Inventors: Souichi Katagiri, Kodaira (JP); Kan Yasui, Kokubunji (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/124,457

(22) Filed: Apr. 18, 2002

(65) Prior Publication Data

US 2002/0111125 A1 Aug. 15, 2002

Related U.S. Application Data

(63) Continuation of application No. 09/634,740, filed on Aug. 8, 2000, now Pat. No. 6,390,895.

(30) Foreign Application Priority Data

Aug. 9, 1999 (JP) ..... 11-224926

(51) Int. Cl.[7] ..... B24B 1/00
(52) U.S. Cl. ..... 56/451
(58) Field of Search ..... 451/36, 37, 41, 451/56, 57, 60, 64, 65, 113, 259, 397, 398, 442, 446, 526; 438/622, 627, 633, 637, 648, 687, 692, 693

(56) References Cited

U.S. PATENT DOCUMENTS

| | | | | |
|---|---|---|---|---|
| 5,643,406 A | | 7/1997 | Shimomura et al. | 156/636.1 |
| 5,665,201 A | | 9/1997 | Sahota | 438/693 |
| 5,857,898 A | | 1/1999 | Hiyama et al. | 451/56 |
| 5,879,226 A | | 3/1999 | Robinson | 451/287 |
| 5,957,757 A | | 9/1999 | Berman | 451/56 |
| 6,004,861 A | * | 12/1999 | Gardner et al. | 257/365 |
| 6,093,080 A | | 7/2000 | Inaba et al. | 451/5 |
| 6,113,462 A | | 9/2000 | Yang | 451/5 |
| 6,174,804 B1 | * | 1/2001 | Hsu | 438/620 |
| 6,184,121 B1 | * | 2/2001 | Buchwalter et al. | 257/522 |
| 6,191,038 B1 | | 2/2001 | Yoshida et al. | 438/691 |
| 6,241,581 B1 | | 6/2001 | Miyashita et al. | 451/41 |
| 6,306,008 B1 | | 10/2001 | Moore | 451/5 |
| 6,326,299 B1 | | 12/2001 | Homma et al. | 438/633 |

FOREIGN PATENT DOCUMENTS

| | | | | |
|---|---|---|---|---|
| JP | 59-136934 | | 8/1984 | |
| JP | 62-114870 | | 5/1987 | |
| JP | 2-185374 | | 7/1990 | |
| JP | 10303155 A | * | 11/1998 | B24B/37/00 |
| WO | WO9710613 | | 3/1997 | |

* cited by examiner

*Primary Examiner*—Joseph J. Hail, III
*Assistant Examiner*—David B. Thomas
(74) *Attorney, Agent, or Firm*—Mattingly, Stanger & Malur, P.C.

(57) ABSTRACT

With a time control means for a wetting treatment of a fixed abrasive platen provided, the fixed abrasive platen is set in a good wet state in advance prior to the start of polishing. The time control means may be incorporated in the body of a flattening/machining apparatus, or alternatively a wetting retaining mean may newly be separately provided instead. While the fixed abrasive platen is rapidly transformed through expansion due to wetting, the wetting treatment is desirably performed till a transformation ratio thereof is stabilized at 0.0005% or less.

18 Claims, 5 Drawing Sheets

FLATTENING AND MACHINING METHOD AND APPARATUS

This is a continuation application of U.S. Ser. No. 09/634,740, filed Aug. 8, 2000 now U.S. Pat. No. 6,390,895.

FIELD OF THE INVENTION

The present invention relates to a method and an apparatus for polishing a semiconductor substrate and particularly, relates to a method and an apparatus for flattening/machining suitable for flattening/machining in the manufacturing process of the semiconductor integrated circuits.

BACKGROUND OF THE INVENTION

A manufacturing process for semiconductor integrated circuits includes many processes of treatments and among them, description will be given of an interconnection process, as an example of a process to which the present invention is applicable, with reference to FIGS. 5A through 5F.

FIG. 5A shows a sectional view of a wafer on which interconnection of the first layer is formed. A dielectric film 16 is formed on a surface of a wafer substrate 15 at which a transistor section has been formed and an interconnection layer 17 made of aluminum or the like is provided on the dielectric film 16.

Since a hole is formed in the dielectric film 16 in order to ensure contact with a transistor, a portion 17' of the interconnection layer 17 corresponding to the hole is more or less sunk downward. In an interconnection process for the second layer shown in FIG. 5B, a dielectric film 18 and a metal aluminum layer 19 are sequentially formed on the first layer and in addition to this, a photo-resist layer 20 for exposure is coated thereon to form an interconnection pattern of the aluminum layer.

Next, a circuit pattern, as shown in FIG. 5C, is exposed to be transferred onto the photo-resist 20 under exposure using a stepper 21. In this situation, a recess and protrusion 22 of the surface of the photo-resist layer 20 cannot be simultaneously in an in-focus condition, leading to a significant obstacle against correct photolithography due to poor optical resolution.

In order to eliminate the above described inconvenience, a flattening process for a substrate surface described below is adopted. Following the process of FIG. 5A, the dielectric layer 18, as shown in FIG. 5D, is formed and thereafter, polishing is applied on the dielectric layer 18 by the method described later such that the layer is flattened off down to the level indicated by a single dot & dash line 23 to attain a state of FIG. 5E. After the flattening, the metal aluminum layer 19 and the photo-resist layer 20 are sequentially formed on the dielectric layer 18 and the photo-resist layer 20 is then exposed with the stepper 21. In this situation, since a photo-resist surface is flat, there arises no problem due to poor optical resolution.

As a flattening process described above, there can be cited here, for example, U.S. Pat. No. 4,944,836 or Japanese laid open patent No. 59-136934 (Japanese patent publication No. 5-30052), in which a flattening/machining method using polishing is disclosed.

In FIG. 6, a diagram of a machining method generally called a chemical, mechanical polishing (CMP) method as a flattening/machining method is shown. In this FIG. 6, a polishing pad 25 is fixedly pasted on a platen 7 and the platen 7 is in rotation by a rotation driving means (a motor) 8. The polishing pad 25 is produced, for example, by slicing foam urethane resin into thin sheets and such sheets are used selecting proper characteristics and fine structure in various ways according to a kind of an object to be machined and a level of surface roughness of finish. On the other hand, a wafer 5 to be machined is fast held on a wafer holder 4 with an elastic packing pad 24 interposed between them. The wafer 5 is pushed down onto a surface of the polishing pad 25 with a load through the wafer holder 4 in rotation and further, a polishing slurry 23 is fed onto the polishing pad 25, so that protrusions of the dielectric film 18 on the surface of the wafer 5 is polished off to flatten.

In a case where a dielectric film, such as silicon dioxide and so on is polished, silica is generally used as the polishing slurry 23. Silica is a suspension obtained by dispersing high-purity fine silica particles of a particle diameter of the order 30 to 150 nm in an aqueous alkaline solution of potassium hydroxide, ammonia or the like and characterized in that a flat, smooth surface with less-work damage can be attained using it.

Further, there is provided a wafer flattening/machining technique in addition to the above described, which uses a fixed abrasive platen made of cerium oxide or the like. While a basic construction of an apparatus is similar to that of a free abrasive grain polishing technique using the polishing pad 25 shown in FIG. 6, a fixed abrasive platen 6 is mounted on a rotating platen 7 as shown in FIG. 7 instead of the polishing pad 25.

With this apparatus, machining can be carried out by feeding just water with no abrasive as a polishing liquid 23 instead of silica or the like. It should be appreciated that a flattening/machining technique in which a fixed abrasive platen 6 is used in the course of a manufacturing process of a semiconductor device has been proposed by the inventors of the present invention, for example, in a PCT patent application (International Publication Number WO 97/10613).

The fixed abrasive platen 6 is composed of abrasive grains, resins and pores. In a case where flattening/machining are carried out using such a fixed abrasive platen 6, there arises a need of a dressing process in which a surface of the fixed abrasive platen 6 is flattened with a diamond dresser, whereby active surfaces of fixed abrasive grains are exposed. If flattening/machining is carried out with no dressing process applied, local concentration of stress occurs in a surface of a wafer, resulting in adverse influences such as deterioration in uniformity across the surface of a wafer and occurrence of scratches thereon and so on.

In the case where flattening/machining is carried out using the fixed abrasive platen 6 as aforementioned in the above description of a prior art, there has been arisen a problem of instability in machining rate (fluctuations in machining amount per unit time). In order to avoid such inconveniences, dressing of the surface of the fixed abrasive platen 6 is performed prior to or during wafer machining, thereby flattening the surface thereof.

However, a performance of the fixed abrasive platen 6 though having been dressed is unstable soon after the start-up of the apparatus, thereby causing such phenomena that machining rates from wafer to wafer are varied and that uniformity across the surface of a wafer is reduced (non-uniform machining). In the prior art, in order to remove such instability, there have been inevitably required the following processes in which: the apparatus is left running with no operation done for a proper length of time after the start-up, that is, a so-called idling time is allowed for the apparatus, a dummy wafer is thereafter fed to confirm its performance and if the performance is confirmed acceptable, production gets started.

However, the requirement of the above processes results in serious problems causing increase in cost and reduction in throughput.

Consequently, it is an object of the present invention to provide a flattening/machining method using an improved fixed abrasive platen so that such a problem of the prior art technology is solved, being excellent in economics and increasing a throughput; and a flattening/machining apparatus, thereby enabling production of high reliability semiconductor devices with ease.

SUMMARY OF THE INVENTION

The inventors of the present invention have conducted experiments in various ways about a polishing method and a polishing apparatus, in which a porous fixed abrasive platen of this kind is used, in order to achieve the above described object, with the result of precious findings that in a process of wetting the fixed abrasive platen, a rapid increase in volume occurs through expansion of the fixed abrasive platen due to wetting in a given time directly after the start of wetting; a shape thereof alters so rapidly that the transformation cannot be neglected.

Therefore, the present invention was made on the basis of such findings based on the experimental facts and has a constitution in which wetting time control means properly wetting a fixed abrasive platen is provided in the body of a flattening/machining apparatus, or alternatively, wetting retaining means is provided separately from the body of the flattening/machining apparatus; with either of both means, the fixed abrasive platen is kept in a proper state of wetting in advance prior to a polishing process; and polishing can be always carried out with the fixed abrasive platen in a most optimal state of wetting at and after the start of polishing.

With such wetting retaining means, there is provided effects that a wetting control time is shortened, an operation rate of the apparatus, in turn, increases and furthermore, confirmation of performance with a dummy wafer can be omitted.

There are shown, here, typical examples of configuration of the present invention so that the above described object can be achieved:

(1) A flattening/machining method for manufacturing a semiconductor device using a porous fixed abrasive platen in which abrasive grains are fixed by a binder, the method including the step of: treating a fixed abrasive platen with wetting treatment liquid in advance prior to the use of the fixed abrasive platen in a flattening/machining process.

While wetting treatment liquid may generally be liquid whose major component is water or alcohol, or machining liquid including abrasive grains depending on circumstances, it is preferably a liquid whose major component is water in common with the machining liquid in a practical aspect. Further, a wetting treatment time in which the fixed abrasive platen is treated with the wetting treatment liquid is usually sufficient in the range from about 60 to about 100 minutes.

(2) A flattening/machining apparatus for manufacturing a semiconductor device including at least: a porous fixed abrasive platen in which abrasive grains are fixed by a binder; a rotary platen for holding the porous fixed abrasive platen; and a machining liquid supply means for supplying machining liquid onto the fixed abrasive platen, wherein the flattening/machining apparatus further includes: a wetting time control means for performing the time control of the rotary platen for holding the porous fixed abrasive platen and the machining liquid supply means, and polishing gets started after the porous fixed abrasive platen is treated with wetting treatment liquid by the wetting time control means for a given time in advance.

Further, in the invention of (2), the following modification can also be adopted: A flattening/machining apparatus including: a wetting retaining means including at least: a treating tank in which the porous fixed abrasive platen is subjected to wetting treatment in advance; the machining liquid supply means; and a drainage means, instead of the wetting time control means, wherein not only is the wetting treatment liquid supplied to the treating tank from the machining liquid supply means of the wetting retaining means, but the porous fixed abrasive platen is subjected to the wetting treatment with the wetting treatment liquid for a given time in advance and thereafter, polishing gets started.

Accordingly, the start-up of the flattening/machining apparatus can be faster and polishing can be effective in a good condition at and after the start of polishing, thereby enabling increase in throughput.

The wetting retaining means includes not only a pressure container useful for the treating tank, but a pressurization means for introducing and pressurizing an inert gas such as nitrogen and argon, for example, in the pressure container through a valve, wherein polishing gets started after the fixed abrasive platen is subjected to a wetting treatment for a given time while being immersed in the wetting treatment liquid contained in the pressure container under a predetermined gas pressure, in advance, thereby enabling the wetting treatment time to further decrease.

DETAILED DESCRIPTION OF THE PREFERRED EMBODIMENT

Detailed description will be given of embodiments of the present invention below with reference to the accompanying drawings.

Figure 1:
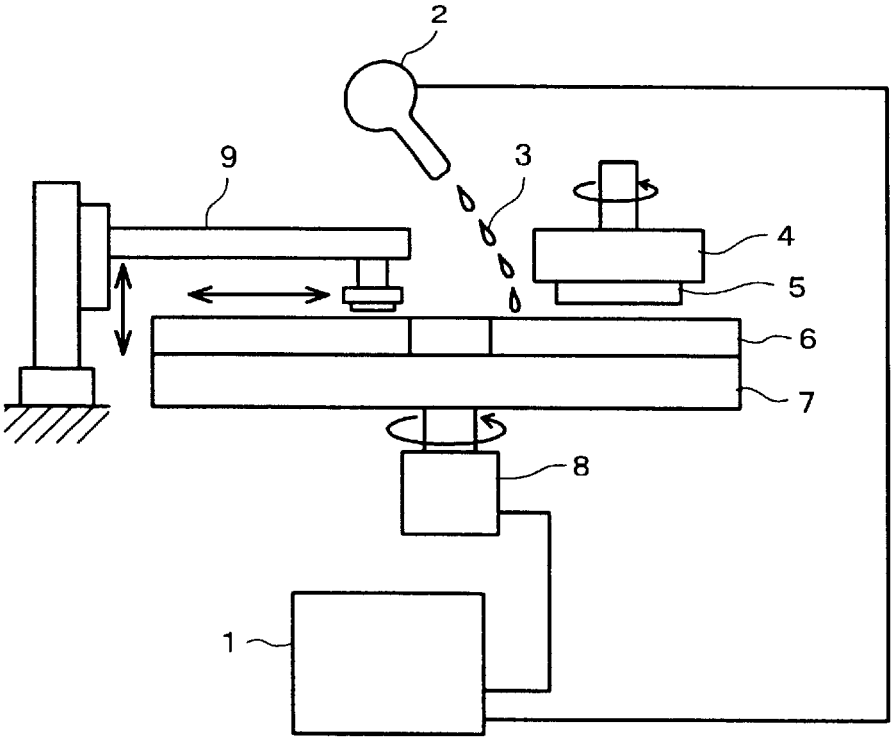
FIG. 1 is a sectional diagram explaining an outline of a flattening/machining apparatus of one embodiment of the present invention.

FIG. 1 is a conceptual diagram showing a basic configuration of the present invention and the configuration of the apparatus includes: a platen 7 for performing polishing; rotation driving means 8 for rotating the platen 7; a fixed abrasive platen 6 mounted on the platen 7; a wafer 5; a wafer holder 4 holding the wafer 5; a machining liquid supply unit 2 for supplying a machining liquid 3 such as water or a slurry in polishing; a conditioner 9 for conditioning a surface of the fixed abrasive platen 6; wetting time control means 1 for controlling operations of the rotation driving means 8 and the machining liquid supply means 2.

In polishing, the machining liquid 3 is supplied from the liquid supply unit 2 and the wafer 5 held on the wafer holder 4 is pushed onto the fixed abrasive platen 6, and in parallel to this, the wafer holder 4 and the platen 7 are simultaneously rotated, whereby polishing is carried out.

Here, further detailed description will be given of the fixed abrasive platen 6.

The fixed abrasive platen 6 is a porous solid composed of abrasive grains of the order from 0.2 to 0.3 $\mu$m in average particle diameter, a resin with which the abrasive grains are fixed in position, and pores.

For abrasive grains, there can be named, for example, silica, $CeO_2$, $Al_2O_3$, $TiO_2$, manganese oxide, iron oxide and so on, and as a resin, there can be named, for example, polyurethane, polyethylene, polyvinyl alcohol and so on. A resin mixed with abrasive grains is molded into a fixed abrasive platen 6 with a porosity of 40 to 60%, for example. A thickness thereof is different according to an object to-be-machined but usually in the range of about 2 to about 25 mm.

When a liquid is poured over such a porous fixed abrasive platen, physical properties (an elasticity, a shape, a tensile strength and so on) are varied due to an intrusion of the liquid into pores on the surface thereof.

Figure 4:
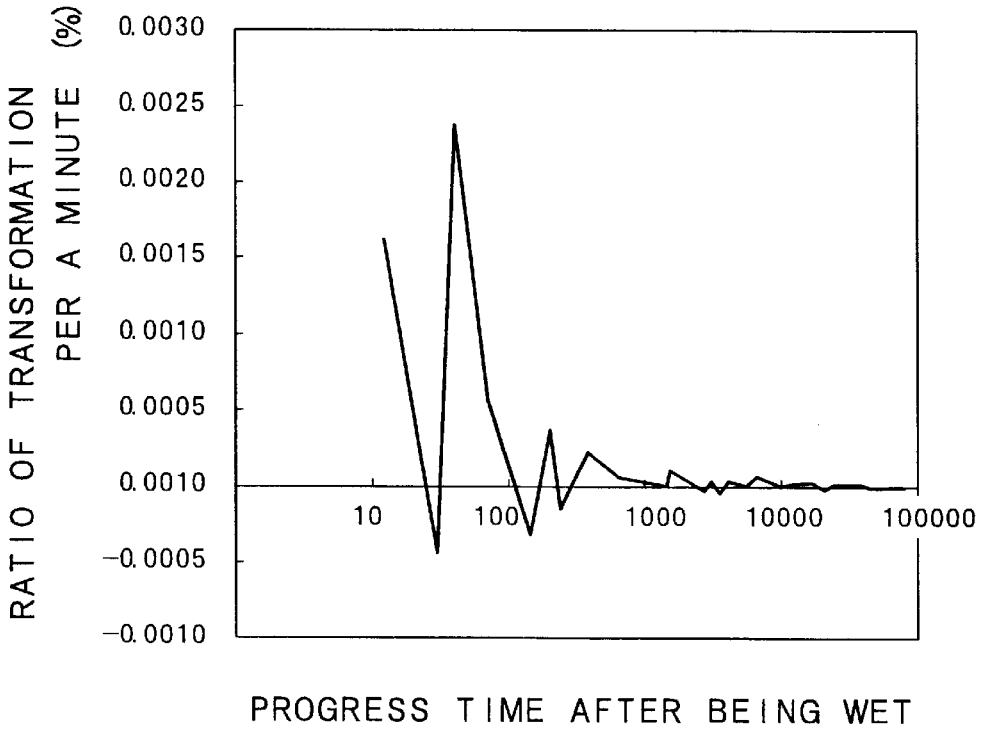
FIG. 4 is a graph explaining a relation between a progress time after being wet and a ratio of transformation of a fixed abrasive platen.
Figure 5A:
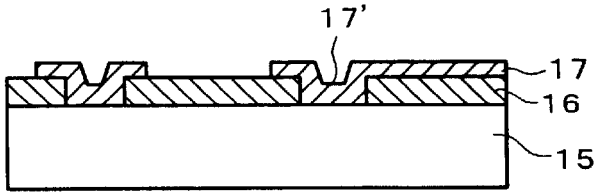
FIGS. 5A to 5F are sectional views showing steps of a manufacturing process for a semiconductor device.
Figure 5B:
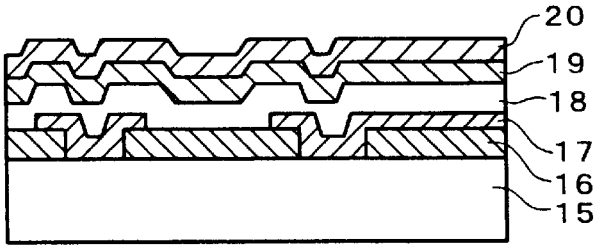
Figure 5C:
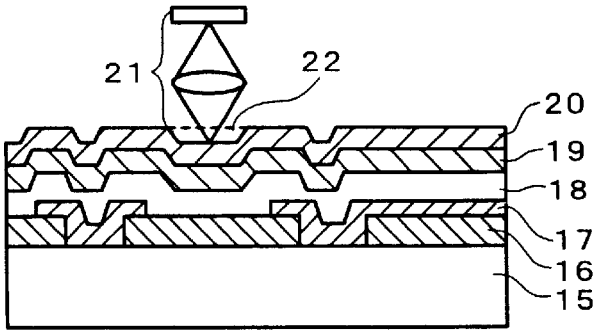
Figure 5D:
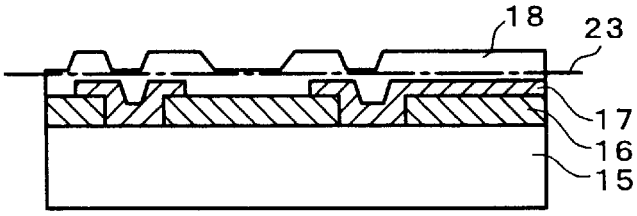
Figure 5E:
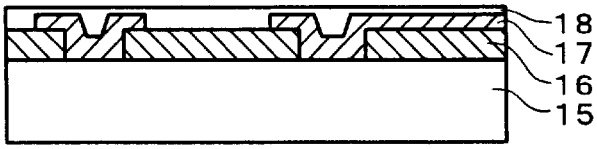
Figure 5F:
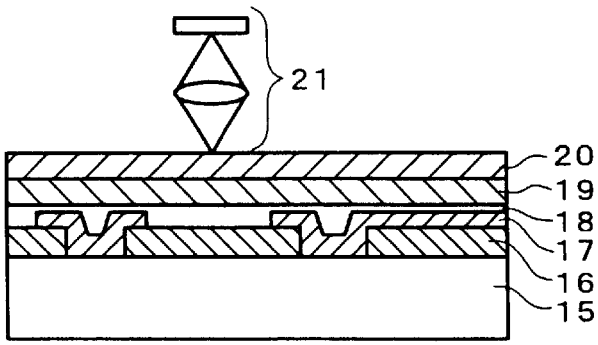
Figure 6:
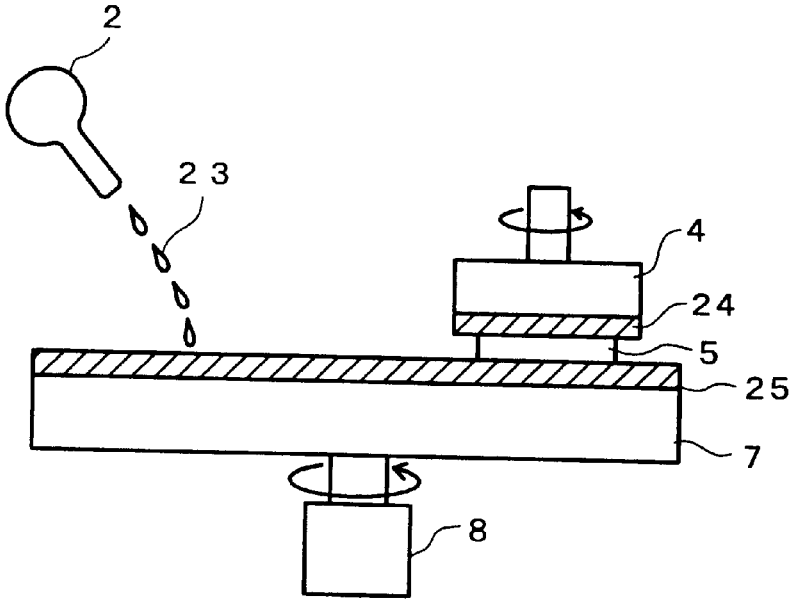
FIG. 6 is a sectional diagram explaining an outline of a prior art flattening/machining apparatus.
Figure 7:
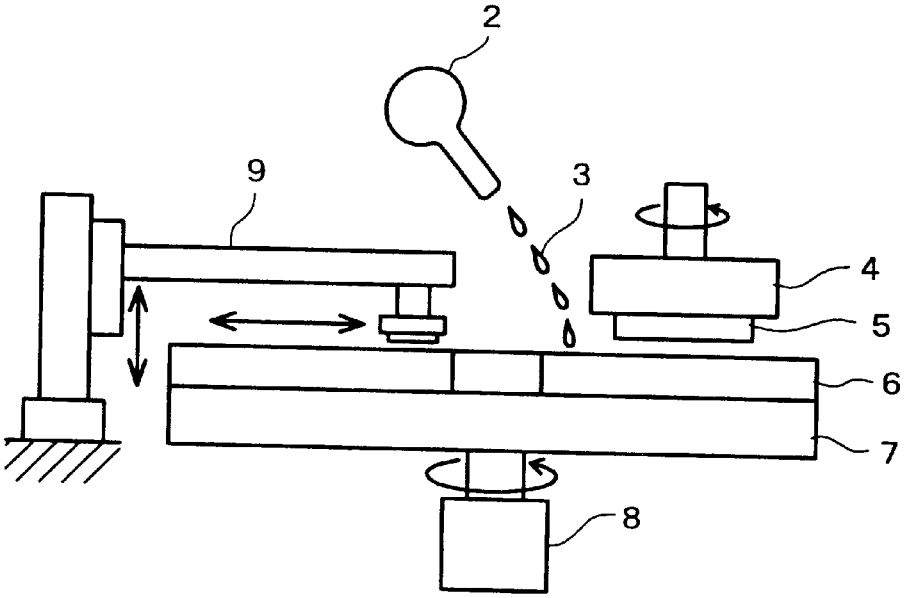
FIG. 7 is a sectional diagram explaining an outline of a prior art flattening/machining apparatus.

FIG. 4 shows a graph of experimental results of a physical property as an example, wherein the ordinate represents a ratio of transformation per minute (% in uniform scale) and the abscissa represents a progress time after being wet (minute in logarithmic scale).

In the experiments, a fixed abrasive platen 6 that was used was formed by molding $CeO_2$ abrasive grains of 0.2 $\mu$m in average particle diameter with a resin, a porosity of the platen 6 was 50% and water was used as a wetting treatment liquid.

It can be understood from the graph that a ratio of transformation per minute of the fixed abrasive platen 6 changes largely according to an elapsed time from a time point at which a wetting treatment gets started. As can be seen from this characteristic, a transformation ratio is large in an initial time soon after the start of wetting and as time elapses, the ratio becomes stabilized at a low value.

This is because an amount of liquid intruding into pores on the surface thereof is larger in the initial time after the start of wetting. In this example, a transformation ratio per minute is stabilized at 0.0005% or less after 60 to 100 minutes from the start of wetting. When implementing such a series of processes that a dry fixed abrasive platen 6 was mounted on the platen 7, thereafter, the machining liquid supply means 2 and the rotation driving means 8 were activated under the control by the wetting time control means 1 while pouring the machining liquid 3 over the fixed abrasive platen 6 and in such a situation, a wetting time of the fixed abrasive platen 6 was controlled so as to elapse 100 minutes after the start of the machining liquid supply, and flattening/machining of a wafer 5 got started on the fixed abrasive platen 6 after a wetting time elapsed the 100 minutes, with the result that a machining rate was favorably stabilized.

It should be appreciated that while the machining liquid 3 is generally composed of water as a major component, it may be a polishing liquid including abrasive grains according to properties of an object to be polished or may contain other chemicals. Further it should be appreciated that while a treatment liquid used in wetting treatment of the fixed abrasive platen 6 in advance to a polishing process is generally composed of water as a major component, water may be replaced with alcohol, and in addition, the treatment liquid may be a machining liquid including abrasive grains according to properties of the object to be polished, provided that in this case, an abrasive grain concentration in the machining liquid is desirably lower than a machining liquid for use in machining a fixed abrasive platen 6.

Next, description will be given of an example for wetting retaining means of the present invention so that a fixed abrasive platen is properly given a wetting treatment.

In the wetting time control means 1 shown in FIG. 1, there is a problem in that machining cannot be conducted during wetting of the fixed abrasive platen 6 since a function of the body of the flattening/machining apparatus is utilized during the wetting. Therefore, there is shown in FIG. 2 an example of wetting retaining means to eliminate the problem.

The wetting retaining means includes: a water tank 90; a liquid supply means 2; and drainage means (a drain 10 and a valve 14). The fixed abrasive platen 6 is only required to be given a wetting treatment for a given time (preferably in the range from 60 to 100 minutes) by the wetting retaining means as a wetting treatment process prior to mounting the fixed abrasive platen 6 on the flattening apparatus shown in FIG. 1. Further, if the fixed abrasive platen 6 is kept immersed in pure water, there arises a problem of occurrence of impurities (fungi or the like). Hence, a machining liquid 3 may be made to flow along a surface of the fixed abrasive platen 6 by opening a valve 14. While the machining liquid 3 may be alcohol instead of water, the alcohol in this case is required to be replaced with pure water prior to the use of the fixed abrasive platen 6.

Next, description will be given of another example of wetting retaining means with reference to an outline view of FIG. 3.

Figure 2:
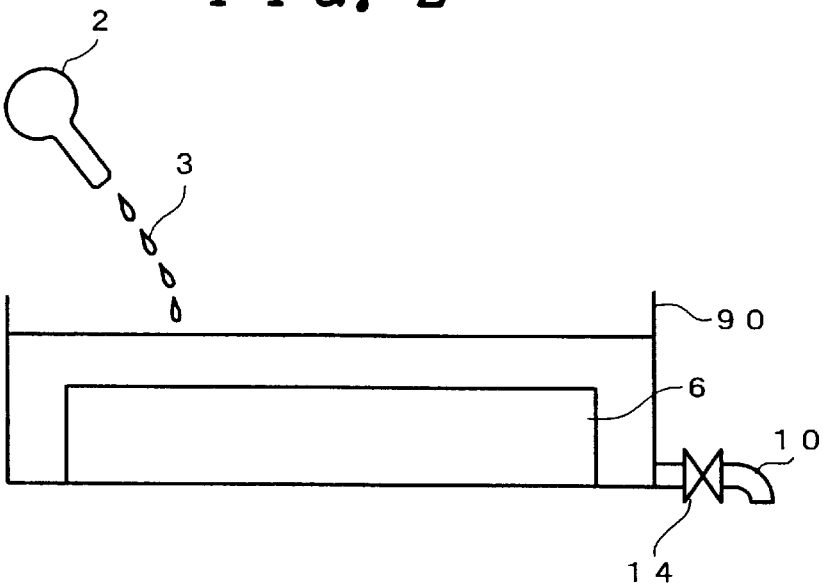
FIG. 2 is a sectional diagram explaining wetting retaining means of another example of the one embodiment.
Figure 3:
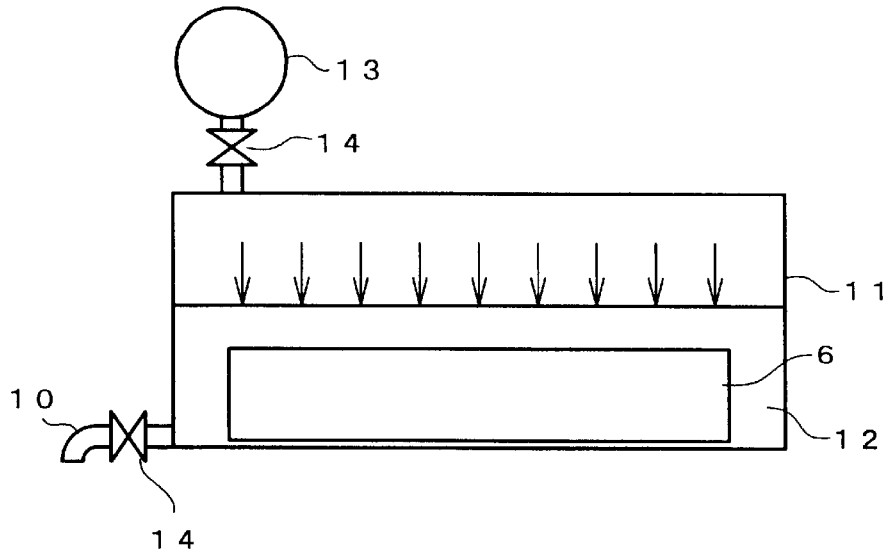
FIG. 3 is a sectional diagram explaining wetting retaining means of still another example of the one embodiment.

While in the example of wetting retaining means shown in FIG. 2, a wetting time is necessary to be of the order from 60 to 100 minutes, a pressure container 11 as shown in FIG. 3 is desirably used since a wetting time for the fixed abrasive platen is shortened (to almost a half the time required otherwise). Pressurization means 13 is connected to the pressure container 11 through a valve 14.

The fixed abrasive platen 6 is inserted into the pressure container 11 and the machining liquid 12 is poured thereinto, and thereafter, a pressure in the container 11 is raised to accelerate, a speed of impregnation of the machining liquid 12 into the interior of the fixed abrasive platen 6. With such means adopted, a wetting time can be shortened and therefore, an operation rate of the apparatus desirably increases.

The pressurization means 13 is a gas tank filled with a pressurized gas (the tank may be equipped with a booster pump) and the valve 14 is controlled so as to set a predetermined pressure acting on a surface of the machining liquid 12 in the pressure container 11.

It should be appreciated that the machining liquid 12 in this case may be alcohol instead of pure water. When alcohol is adopted as the machining liquid 12, the alcohol is required to be replaced with pure water before the fixed abrasive platen 6 is actually used in operation. Further, if a pressurized inert gas, such as nitrogen or argon, is used, the pressurized gas is desirably adopted to prevent fungi or corrosion. A pressure of the gas is set in the range from about 2 to about 5 atm, for example, and the fixed abrasive platen is left for a time from about 30 to about 50 minutes under a pressure in the range.

The wetting time control means for the fixed abrasive platen 6 is incorporated in a flattening apparatus to effectively utilize a floor space in a factory. Further, when the means is compact and lightweight, it can also serve as transport means, and the transfer between lines can be done with no care against contamination of a work by using such a transport means.

Description will be given of examples as application of a method and apparatus for flattening/machining of the present invention to a manufacturing process of a semiconductor device, below.

EXAMPLE 1

One example of manufacturing process of a semiconductor device is described with reference to sectional views as shown in FIGS. 8A to 8D and 8E to 8G. Note that flattening of a dielectric film 18 was performed through polishing with a flattening apparatus of FIG. 1.

Figure 8A:
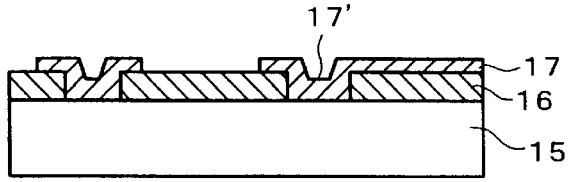
FIGS. 8A to 8D are sectional views showing steps of a manufacturing process for a semiconductor device based upon an example of the one embodiment of the present invention.

First, as shown in a process of FIG. 8A, there is provided a wafer on which interconnection 17 of the first layer is formed by a well known method in advance. That is, a dielectric film 16 is formed on a surface of a wafer substrate 15 at which a transistor portion is formed and the first interconnection layer 17 made of aluminum or the like is provided thereon.

Since a hole is formed in the dielectric film 16 in order to ensure contact with a transistor, a portion 17' of the interconnection layer 17 corresponding to the hole is more or less sunk downward.

Figure 8B:
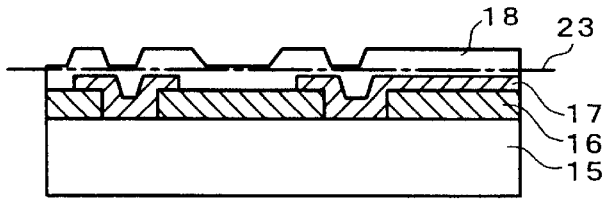
Figure 8C:
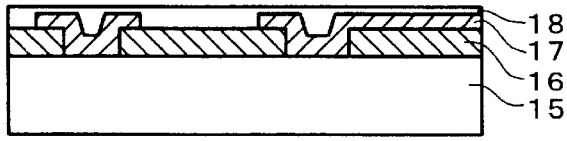
Figure 8D:
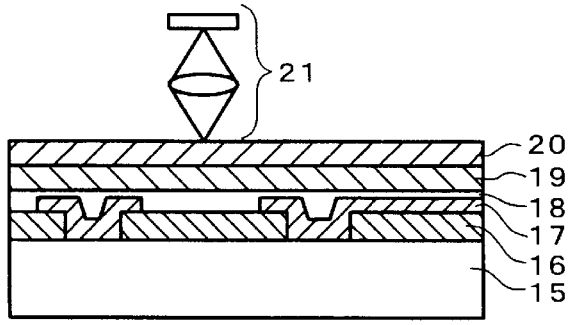

Next, as shown in a process of FIG. 8B, a dielectric layer 18 is formed thereon and polished off so as to be flattened to a level indicated by a single dot & dash line 23 in the figure by a method described later to achieve a state of FIG. 8C. Thereafter, a metal aluminum layer 19 and a photo-resist layer 20 are formed and the photo-resist layer 20 is exposed to light with a stepper 21 as shown in FIG. 8D. In this situation, no problem of poor optical resolution occurs since the surface of the resist is flat.

Figure 8E:
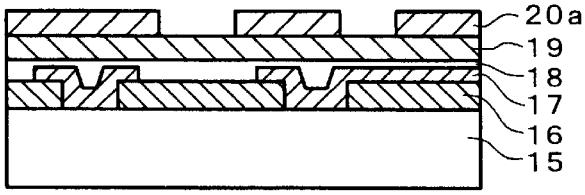
FIGS. 8E to 8G are sectional views showing steps of a manufacturing process for a semiconductor device based upon an example of the one embodiment of the present invention.
Figure 8F:
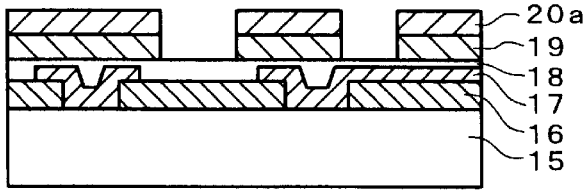

Next, in a process of FIG. 8E, the photo-resist layer 20 is selectively removed to form a mask pattern 20*a* and subsequent to this, in a process of FIG. 8F, the metal aluminum layer 19 is selectively etched using the mask pattern 20*a*.

Figure 8G:
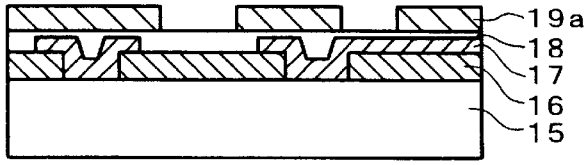

In a process of FIG. 8G, the mask pattern 20*a* is removed to obtain the second interconnection layer 19*a*. Thereafter, a series of processes from the process of FIG. 8B to the process of FIG. 8G is repeated for the number of the required multi-layer interconnection and thereby, a desired multi-layer interconnection structure can be formed with ease.

Now, descriptions will be given of formation and polishing process of the dielectric layer 18 covering from the process of FIG. 8B to the process of FIG. 8C. The dielectric layer 18 was deposited with silicon oxide by means of a well-known CVD method to a thickness of 1 $\mu$m. Polishing for flattening the dielectric layer 18 was performed with the flattening/machining apparatus of FIG. 1.

Prior to polishing, under control of the wetting time control means 1, a wetting treatment of the fixed abrasive platen 6 was carried out while supplying water as a treatment liquid from the liquid supply unit 2 onto the fixed abrasive platen 6 in rotation at a predetermined rotation speed for about 100 minutes.

In succession to the wetting treatment, not only was water as a machining liquid supplied onto the fixed abrasive platen 6 from the liquid supply unit 2, but the wafer 5 on which the dielectric layer 18 had been formed was also pushed to the fixed abrasive platen 6 with the dielectric layer 18 of the wafer 5 in contact with the platen 6 and in parallel to such workings, the wafer holder 4 and the platen 7 were simultaneously rotated to perform polishing of the wafer 5. As a result, there arose no problems such as deterioration in uniformity across the surface of the wafer and production of scratches thereon, thus enabling a good, flattened/machined surface of the wafer 5 with the least fluctuation in machining rate.

It should be appreciated that the fixed abrasive platen 6 in use was one produced by molding a resin as a binder, mixed with abrasive grains (made of $CeO_2$) of 0.3 $\mu$m in average particle diameter so as to be of the porosity of 50% and by slicing to a sheet of a thickness of 20 mm.

EXAMPLE 2

The flattening/machining process of Example 1 was performed using a fixed abrasive platen 6 that had been given a wetting treatment in advance through the wetting retaining means according to FIG. 2. The water tank 90 was filled with pure water as a wetting treatment liquid and in the tank 90, the fixed abrasive platen 6 was left immersed for about 100 minutes and thereafter, the fixed abrasive platen 6 was mounted on the platen 7 of the flattening apparatus of FIG. 1; and using the apparatus, polishing for flattening similar to Example 1 was carried out. In this case, a result similar to Example 1 was obtained as well.

EXAMPLE 3

This example was performed using a fixed abrasive platen 6 that had been treated in advance through wetting retaining means of FIG. 3 instead of the wetting retaining means according to FIG. 2 in Example 2. In this example, the pressure container 11 is filled with pure water and in a wetting treatment, the fixed abrasive platen 6 was immersed in the pure water for 30 minutes in a nitrogen atmosphere under pressure of 2 atm acting on the surface of the pure water. After the immersion, the fixed abrasive platen was mounted on the platen 7 of the flattening apparatus of FIG. 1 and polishing for flattening was carried out, similar to Example 2. In this case, while a wetting treatment was shorter in time (30 minutes, about half the time of Example 2) than in Example 2, an effect similar to Example 2 was attained.

As detailed above, according to the present invention, the desired object to solve a problem associated with flattening arising when a prior art fixed abrasive platen 6 is used has been able to be achieved. That is, in connection with a flattening technique for a surface pattern using polishing of a semiconductor wafer, there can be reduced fluctuations in machining rate and non-uniform machining, in which the machining rate has been unstable according to a technique using a prior art fixed abrasive platen.

Further, since the number of dummy wafers for use in evaluation of a performance of the apparatus, which has been necessary, can be decreased, an effect is exerted of reduction in cost. In the prior art, there were required indispensable processes in which: after the start-up period of a polishing apparatus was over, the apparatus was left running for a proper time length with no polishing, that is, an idling time was set prior to actual operation, thereafter a dummy wafer was fed and test polishing is conducted in order to confirm a performance of the apparatus, and if the performance was confirmed acceptable, feeding of wafers for production got started.

However, in the present invention, such processes required in the prior art are not necessary.

What is claimed is:

1. A semiconductor device manufacturing method, the method comprising the steps of:

forming a first metal layer connected to a semiconductor substrate through a via hole of an insulating film;

forming an insulating layer having convex/concave portions on the first metal layer;

planarizing the insulating layer to a level between the concave portion of the insulating layer and an upper surface of the first metal layer by a polishing method; and depositing a second metal layer on the planarized insulating layer and patterning the second metal layer, wherein the polishing method is comprised of the following steps:

preparing a porous fixed abrasive platen for polishing;

immersing the porous fixed abrasive platen for a predetermined period of 60 to 100 minutes in a liquid including water and alcohol; and planarizing the insulating layer by using the porous fixed abrasive platen treated by said immersing step.

2. A semiconductor device manufacturing method according to claim 1, wherein the liquid of the immersing step includes water, alcohol and a polishing liquid.

3. A semiconductor device manufacturing method according to claim 1, wherein the immersing step is conducted in the presence of an inert gas.

4. A semiconductor device manufacturing method according to claim 1, wherein the immersing step is conducted in the presence of nitrogen or argon gas.

5. A semiconductor device manufacturing method according to claim 1, wherein the immersing step is conducted in the presence of a pressurized inert gas over atmospheric pressure.

6. A semiconductor device manufacturing method according to claim 1, wherein the immersing step is conducted until a range of transformation rate per minute of the porous fixed abrasive platen becomes 0.0005%.

7. A semiconductor device manufacturing method, the method comprising the steps of:

forming a first metal layer;

forming a first insulating layer having convex/concave portions on the first metal layer;

planarizing the first insulating layer to a level between the concave portion of the first insulating layer and an upper surface of the first metal layer by a polishing method;

depositing a second metal layer on the planarized first insulating layer and patterning the second metal layer;

forming a second insulating layer having convex/concave portions on the second metal layer;

planarizing the second insulating layer to a level between the concave portion of the second insulating layer and an upper surface of the second metal layer by the polishing method;

wherein the polishing method is comprised of the following steps:

preparing a porous fixed abrasive platen for polishing;

immersing the porous fixed abrasive platen for a predetermined period in a liquid including water and a polishing liquid; and planarizing by using the porous fixed abrasive platen treated by the immersing step.

8. A semiconductor device manufacturing method according to claim 7, wherein the liquid of the immersing step includes water, alcohol and the polishing liquid.

9. A semiconductor device manufacturing method according to claim 7, wherein the immersing step is conducted in the presence of an inert gas for a period of 60 to 100 minutes.

10. A semiconductor device manufacturing method according to claim 7, wherein the immersing step is conducted in the presence of nitrogen or argon gas.

11. A semiconductor device manufacturing method according to claim 7, wherein the immersing step is conducted in the presence of a pressurized inert gas over atmospheric pressure.

12. A semiconductor device manufacturing method according to claim 7, wherein the immersing step is conducted until a range of a transformation rate per minute of the porous fixed abrasive platen becomes 0.0005%.

13. A semiconductor device manufacturing method, the method comprising the steps of:

forming a first metal layer on a semiconductor substrate;

forming an insulating layer having convex/concave portions on the first metal layer;

planarizing the insulating layer by a polishing method; and depositing a second metal layer on the planarized insulating layer and patterning the second metal layer, wherein the polishing method is comprised of the following steps:

preparing a fixed abrasive platen for polishing;

immersing the fixed abrasive platen for a predetermined period in a liquid including water and a polishing liquid; and planarizing the insulating layer by using the fixed abrasive platen treated by the immersing step.

14. A semiconductor device manufacturing method according to claim 13, wherein the liquid of the immersing step includes water, alcohol and the polishing liquid.

15. A semiconductor device manufacturing method according to claim 13, wherein the immersing step is conducted in the presence of an inert gas.

16. A semiconductor device manufacturing method according to claim 13, wherein the immersing step is conducted in the presence of nitrogen or argon gas.

17. A semiconductor device manufacturing method according to claim 13, wherein the immersing step is conducted in the presence of a pressurized inert gas over atmospheric pressure.

18. A semiconductor device manufacturing method according to claim 13, wherein the immersing step is conducted until a range of a transformation rate per minute of the porous fixed abrasive platen becomes 0.0005%.

* * * * *